US005255061A

United States Patent [19]

Matsuura et al.

[11] Patent Number: 5,255,061

[45] Date of Patent: Oct. 19, 1993

[54] IMAGE FORMING APPARATUS WITH A FIRST AND SECOND LID

[75] Inventors: Yozo Matsuura, Machida; Shiroh Kondoh, Atsugi; Kazuhiro Yuasa, Zama, all of Japan

[73] Assignee: Ricoh Company, Ltd., Tokyo, Japan

[21] Appl. No.: 620,067

[22] Filed: Nov. 30, 1990

[30] Foreign Application Priority Data

Dec. 4, 1989 [JP] Japan ..... 1-313450

[51] Int. Cl.[5] ..... G03G 21/00

[52] U.S. Cl. ..... 355/298; 355/211; 355/271

[58] Field of Search ..... 355/271, 274, 277, 200, 355/210, 211, 308, 309, 296, 298

[56] References Cited

U.S. PATENT DOCUMENTS

| | | | |
|---|---|---|---|
| Re. 33,484 | 12/1990 | Imamaka | 355/298 |
| 4,703,455 | 11/1987 | Kubota et al. | 355/211 |
| 4,754,293 | 6/1988 | Aizawa et al. | 346/160 |
| 4,766,403 | 8/1988 | Sasaki et al. | 355/212 |
| 4,768,055 | 8/1988 | Takamutsu et al. | 222/DIG. 1 X |
| 4,772,915 | 7/1990 | Kando | 346/153.1 X |
| 4,791,454 | 12/1988 | Takahashi et al. | 355/15 |
| 4,862,209 | 8/1989 | Sakamoto et al. | 355/211 |
| 4,896,191 | 1/1990 | Ohyabu et al. | 355/309 |
| 4,908,661 | 3/1990 | Iwata et al. | 355/211 |
| 4,941,002 | 7/1990 | Maruyama et al. | 346/160 |
| 4,956,676 | 9/1990 | Fukae et al. | 355/271 |
| 4,989,045 | 1/1991 | Clayton et al. | 355/260 |
| 4,992,835 | 2/1991 | Matsuzaka | 355/312 |
| 5,030,988 | 7/1991 | Haneda et al. | 355/200 |
| 5,038,228 | 8/1991 | Takada | 355/308 X |
| 5,047,801 | 9/1991 | Haneda et al. | 355/200 |
| 5,065,195 | 11/1991 | Haneda et al. | 355/210 |

FOREIGN PATENT DOCUMENTS

| | | | |
|---|---|---|---|
| 0240337 | 10/1987 | European Pat. Off. . | |
| 0248682 | 12/1987 | European Pat. Off. . | |
| 2850965 | 5/1979 | Fed. Rep. of Germany . | |
| 3422358 | 12/1984 | Fed. Rep. of Germany . | |
| 3810558 | 10/1988 | Fed. Rep. of Germany . | |
| 0208065 | 9/1986 | Japan | 355/260 |

*Primary Examiner*—Leo P. Picard
*Assistant Examiner*—Christopher Horgan
*Attorney, Agent, or Firm*—Oblon, Spivak, McClelland, Maier & Neustadt

[57] ABSTRACT

An image forming apparatus, which forms a predetermined image on each recording paper of a plurality of recording papers and ejects each recording paper therefrom through a feed path, includes a body and a first lid. The first lid is pivotably provided on the body so as to pivot from a closing position to an opening position, and the feed path is mostly exposed when the first lid is located at the opening position. The body includes photosensitive member, a latent image forming device, and a developing device, whereas the first lid includes merely a transfer device so that the first lid is light enough to be opened easily. In addition, a jammed paper can be removed easily from the feed path because the feed path is mostly exposed when the first lid is located at the opening position.

9 Claims, 5 Drawing Sheets

SCANNER PART 28
SECOND LID 29
B
28
27 BODY
BOOK
SHEET SCANNER PART 28a
BOOK SCANNER PART 28a
4 EXPOSURE UNIT
5
11 RECORDING PAPER CASSETTE
12
23
24
3
7
9
10
21
22
13
14
20
2
8
15
1
25 FULCRUM
FIXING ROLLER 18
PUSH ROLLER 19
PHOTOSENSITIVE BELT
TRANSFER CHARGER 17
16
RESIST ROLLERS

IMAGE FORMING APPARATUS WITH A FIRST AND SECOND LID

BACKGROUND OF THE INVENTION

The present invention relates generally to image forming apparatuses, and more particularly to an image forming apparatus which forms a predetermined image on each recording paper of a plurality of recording papers and ejects each recording paper therefrom through a feed path, such as a facsimile equipment unit, a laser printer, a copying machine, or the like.

In a conventional electrophotograph recording apparatus shown in FIG. 1, a predetermined image is transferred on the recording paper 12 from a recording paper cassette 11 by a developing roller 8 before it is ejected to a tray 21. A brief description will now be given of a conventional image forming process of the electrophotograph recording apparatus with reference to FIG. 1. The electrophotograph recording apparatus generally uses a rotary polygon mirror 5 for sweeping among the plane scanning methods. A laser beam appropriate to image signals from a laser beam unit is reflected on the polygon mirror 5 so as to be irradiated to the photosensitive (photoconductive) belt 1 via a mirror 6 and a plastic cylindrical lens 7 in a exposure unit 4 to form a static latent image thereon. The photosensitive belt 1, moved around by driving rollers 2, is charged with electricity by a precharger 3 in advance of the transferring operation. The latent image on the photosensitive belt 1 is developed by the developing roller 8 with toner supplied from a toner cartridge 9 and a hopper 10. On the other hand, the recording paper 12 is fed at a proper time from the recording paper cassette 11 to a transfer charger 17 so that the image can be transferred thereon, via a pickup roller 13, a feed roller 14, a separate roller 15 and a pair of resist rollers 16. The feed roller 14 feeds the uppermost recording paper from among the recording papers fed by the pickup roller 13 which is coupled to the recording paper cassette 11. And the separating roller 15, coupled to the feed roller 14, separates the recording paper 12 from the pile of recording papers. After being transferred, the recording paper 12 is ejected to a tray 21 via a fixing roller 18, a pushing roller 19, and a pair of ejecting rollers 20. The fixing roller 18, a part of the fixing apparatus (not shown), has a heater therein to fix the predetermined image on the recording paper 12. And the push roller 19, coupled to the fixing roller 18, pushes the fixing roller 18 so as to fix the predetermined image on the recording paper 12. Meanwhile, the remains of the toner on the photosensitive belt 1 is removed by a cleaning blade 22 in a toner recovery chamber 23, and then the cleaned photosensitive belt 1 is discharged by a discharge lamp 24 to prepare for the next process.

Hereupon, the electrophotograph recording apparatus in FIG. 1 conventionally comprises a lower unit and an upper unit coupled to the lower unit pivotably around a fulcrum 25, as shown in FIG. 2, so that the upper unit can be opened in case the recording paper 12 is jammed. As shown in FIG. 2, the upper unit includes many parts of the electrophotograph recording apparatus, such as the photosensitive belt 1, the exposure unit 4, and the discharge lamp 24, which are described above, and moreover, a paper supply roller, a reading lens, a charged-coupled device (called for short CCD) image sensor and the like.

On the other hand, it is required that the conventional electrophotograph recording apparatus is opened even when the toner cartridge 9 and/or the toner recovery chamber 23 are exchanged. Therefore, they must be placed to face an opening of the electrophotograph recording apparatus so they can be exchanged easily.

However, the conventional electrophotograph recording apparatus has the following disadvantages.

1. It is troublesome to open the heavy upper unit having many parts therein.
2. It is necessary to provide a safety device for preventing the upper unit from colliding with the lower unit while the upper unit is being opened, however, such a device costs a lot.
3. A developing unit comprising the developing roller 8, toner cartridge 9, and hopper 10 and the toner recovery chamber 23 are facing the opening so that they obstruct the way by which the jammed recording paper is removed.
4. It is difficult to place a book scanner on the upper surface of the electrophotograph recording apparatus in order to prevent the upper unit from increasing its weight.

SUMMARY OF THE INVENTION

Accordingly, it is a general object of the present invention to provide a novel and useful image forming apparatus in which the disadvantages described above are eliminated.

Another object of the present invention is to provide an image forming apparatus from which a jammed paper can be easily removed.

Still another object of the present invention is to provide an image forming apparatus comprising at least two units, at least one of which is so light that it can be easily opened to remove the jammed paper.

Another more specific object of the present invention is to provide an image forming apparatus which forms a predetermined image on each recording paper of a plurality of recording papers and ejects each recording paper therefrom through a feed path, which image forming apparatus comprises a body, and a first lid, pivotably provided on the body so as to pivot from a closing position to an opening position, the first lid closing the body when the first lid is located at the closing position, and the feed path being mostly exposed when the first lid is located at the opening position, wherein the body comprises a first paper storing member to which the recording paper is supplied so as to be stored therein, a photosensitive member, latent image forming means for forming a latent image appropriate to the predetermined image on the photosensitive member, developing means for developing the latent image on the photosensitive member with toner after the latent image forming means forms the latent image on the photosensitive member, and a second paper storing member to which the recording paper transferred the predetermined image thereto is ejected, the recording paper being fed from the first paper storing member to the second paper storing member, and wherein the first lid comprises transfer means for transferring the latent image to the recording paper after the developing means develops the latent image on the photosensitive member with toner.

According to the present invention, the first lid includes few image forming parts so that it is light enough to be opened easily. In addition, when the first lid is located at the opening position, the feed path is mostly exposed so that the jammed paper can be removed easily.

Other objects and further features of the present invention will become apparent from the following detailed description when read in conjunction with the accompanying drawings.

DESCRIPTION OF PREFERRED EMBODIMENTS

Figure 1:
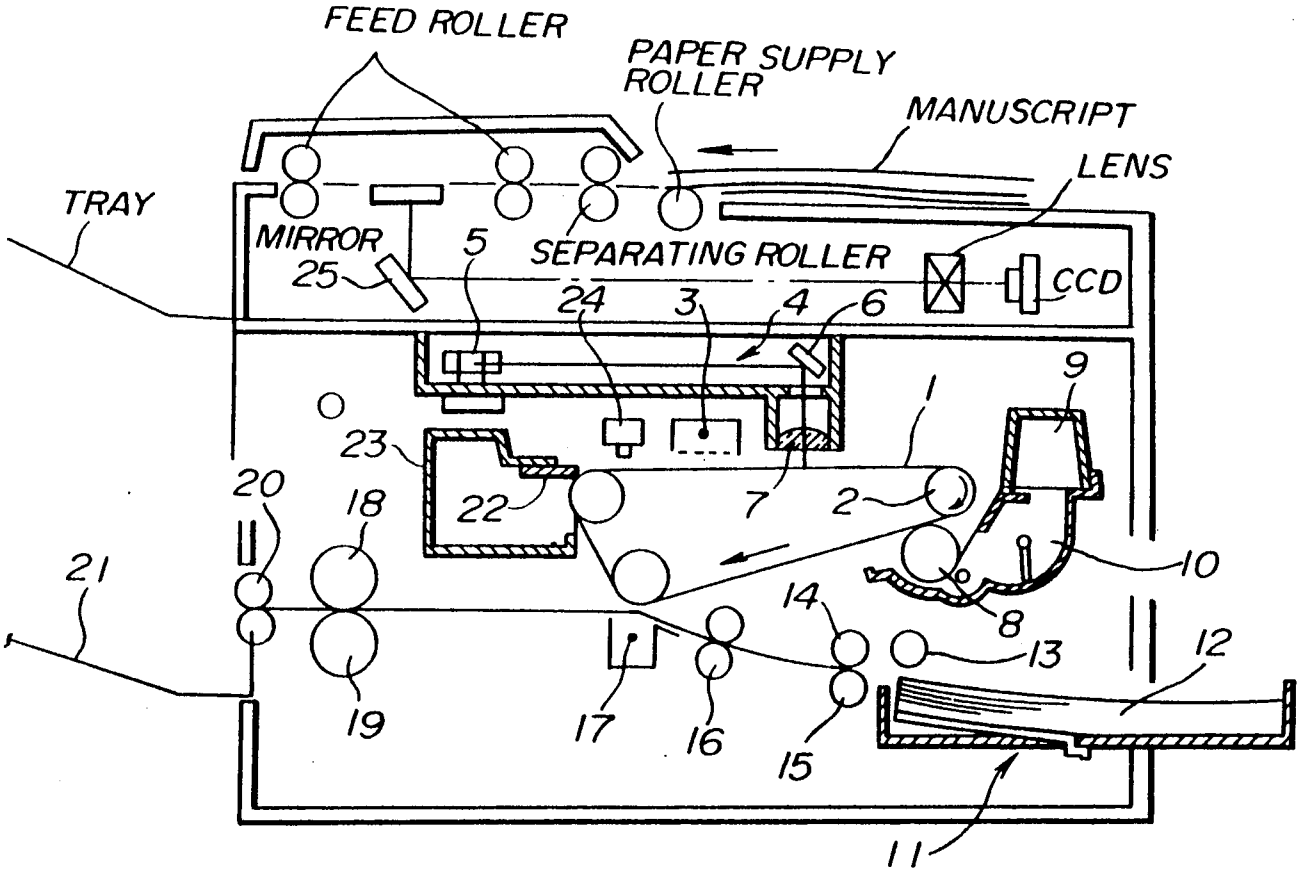
FIG. 1 PRIOR ART
FIG. 1 is a cross-sectional view of a electrophotograph recording apparatus.
Figure 2:
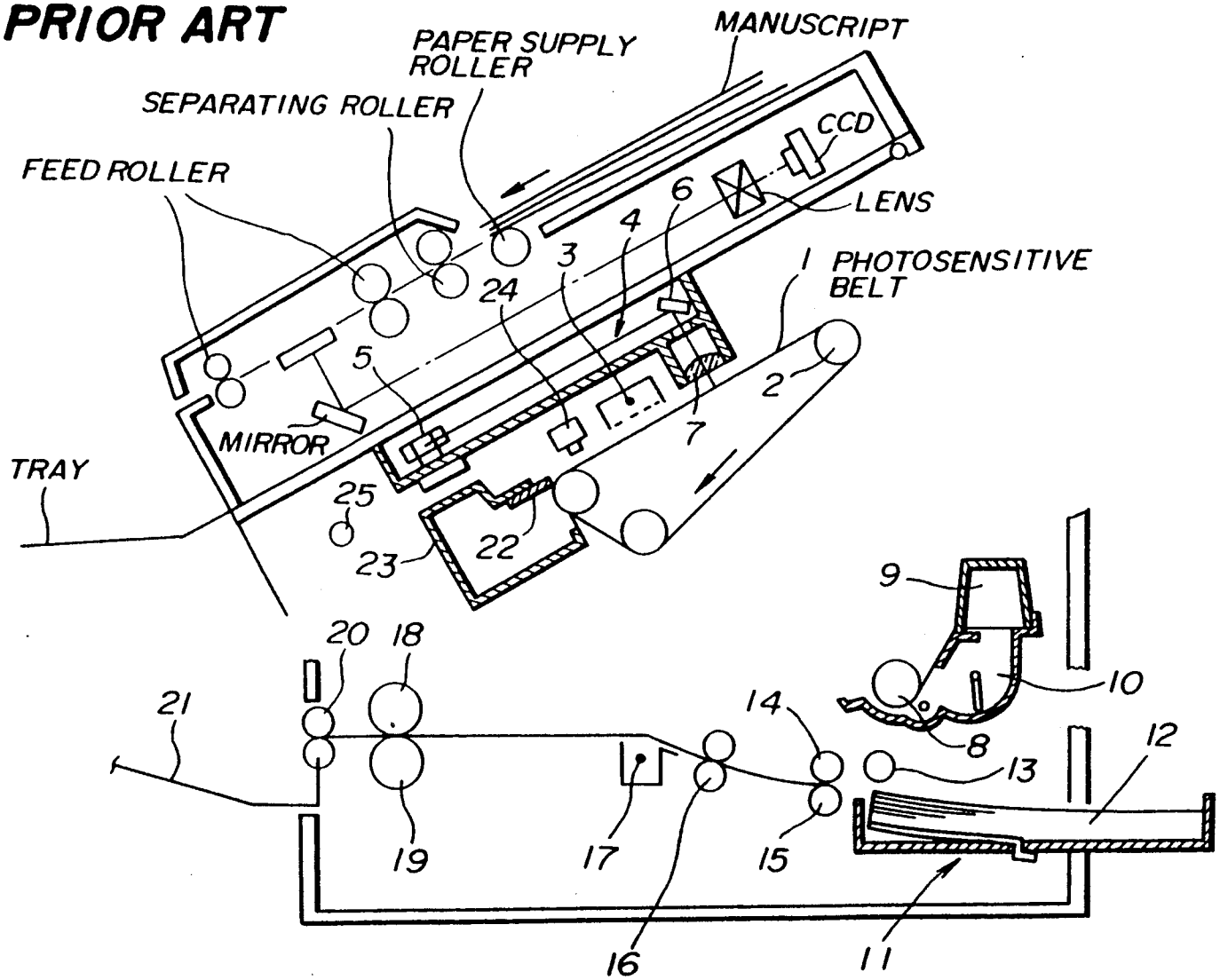
FIG. 2 PRIOR ART
FIG. 2 is a cross-sectional view of the electrophotograph recording apparatus in FIG. 1 divided into two units.

A description will now be given of an image forming apparatus of a first embodiment according to the present invention with reference to FIG. 3 and FIG. 4. Those parts in FIG. 3 and FIG. 4 designated by the same reference numerals as in FIG. 1 and FIG. 2 correspond to the same parts, and a description thereof will be omitted.

In the conventional electrophotograph recording apparatus, exchanging means for exchanging the toner cartridge 9 and the toner recovery chamber 23 and removing means for removing the jammed paper are coupled to a single means for opening the upper unit. In view of this, one of the characteristics of the present invention is to separate the exchanging means from the removing means. To remove the jammed paper easily, it is preferable to open the upper unit along a feed path through which the recording paper 12 is fed from the recording paper cassette 11 to the tray 21. But it has been previously impossible to divide the conventional electrophotograph recording apparatus along the feed path for the purpose of exchanging the toner cartridge 9 and the toner recovery chamber 23, that is, both must face the opening so as to be exchanged.

Figure 3:
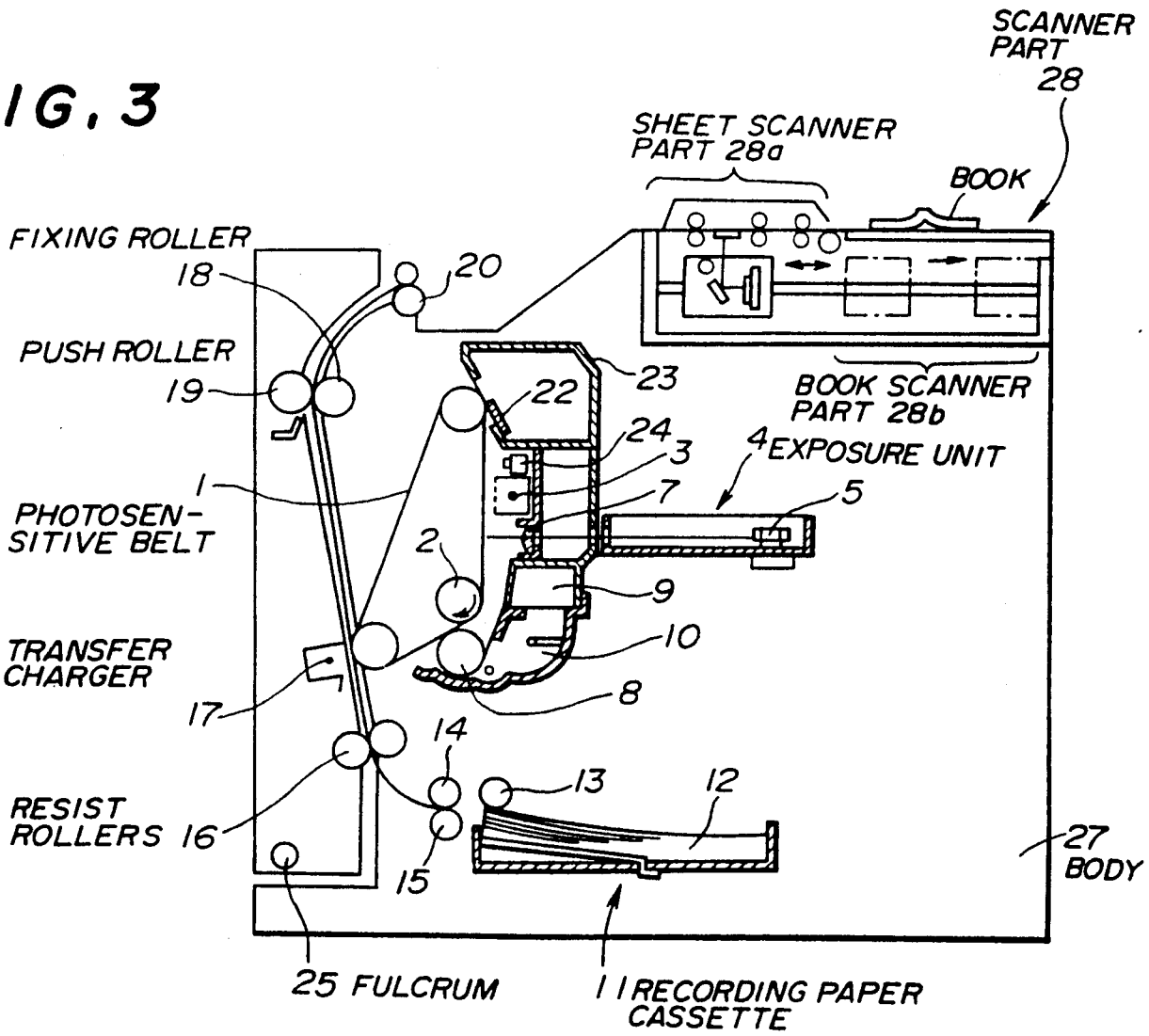
FIG. 3 is a cross-sectional view of a electrophotograph recording apparatus of a first embodiment according to the present invention.
Figure 4:
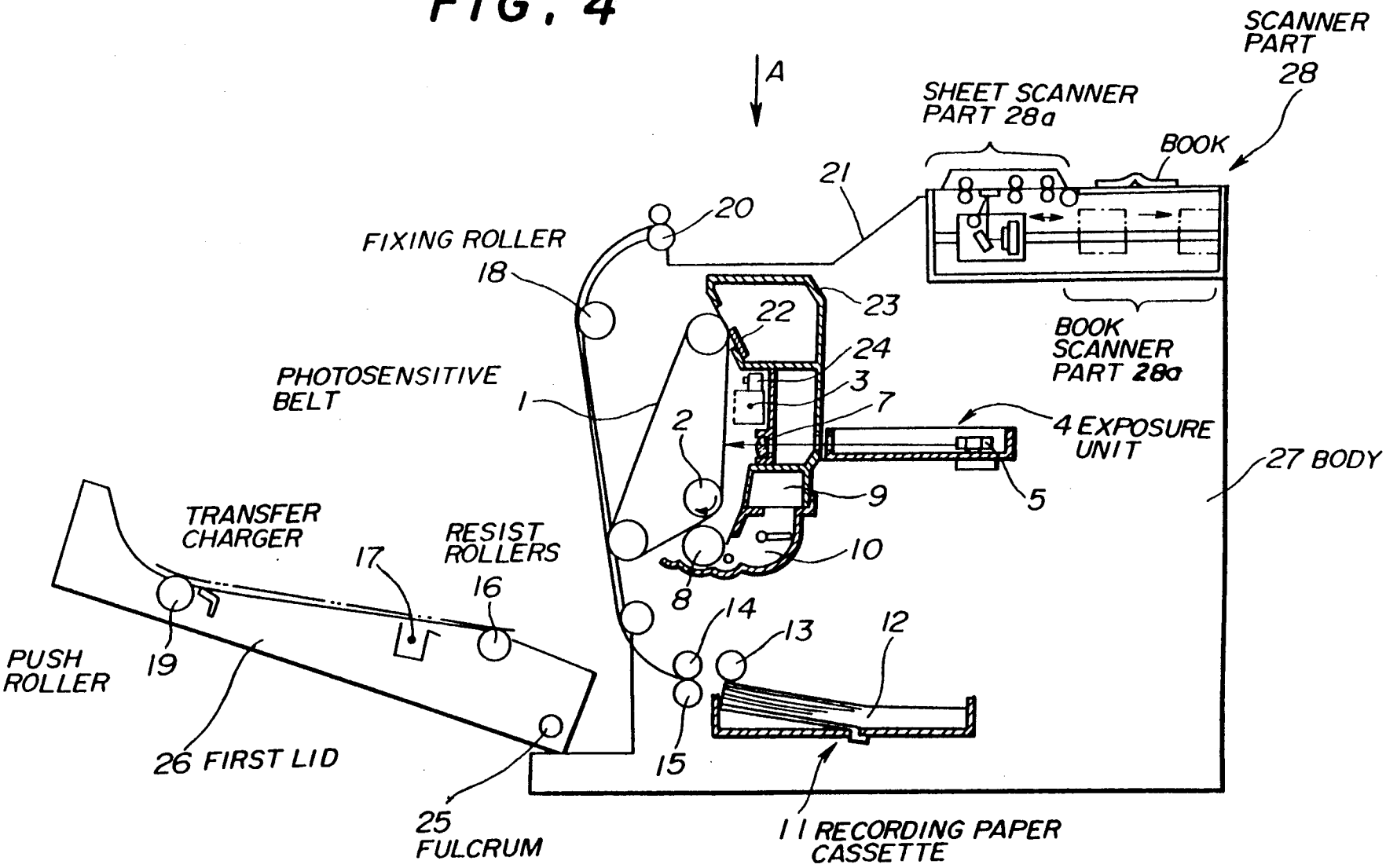
FIG. 4 is a cross-sectional view of the electrophotograph recording apparatus in FIG. 3 divided into two units.

As shown in FIG. 3 and FIG. 4, the electrophotograph recording apparatus has the recording paper cassette 11 at the bottom thereof, and the feed path extends upwardly. The electrophotograph recording apparatus according to the present invention has a first lid 26 openable approximately along the feed path around the fulcrum 25 to be apart from a body 27 and scanner part 28. The first lid 26 includes the resist roller 16, transfer charger 17 and push roller 19. The resist roller 16 and the push roller 19 of the first lid 26 are driven by another resist roller 16 an the fixing roller 18 of the body 27. Therefore, the first lid 26 does not have to include any motors for driving the resist roller 16 and the push roller 19. The first lid 26 is opened only when the jammed paper is to be removed. The first lid 26 can be opened approximately along the feed path so that the jammed paper can be easily removed. As mentioned above, the electrophotograph recording apparatus according to the present invention has the following advantages over the conventional one. Firstly, the first lid 26 includes light parts such enough enable the same to be opened easily. Moreover, it is not necessary to provide an expensive safety device. Secondly, the feed path is mostly exposed when the first lid 26 is opened so that the jammed paper can be removed easily. Thirdly, the first lid 26 includes the push roller 19 so that particularly the jammed paper in the vicinity of the fixing roller 18 can be easily removed. Fourthly, it is also easy to exchange expendable parts, such as the resist roller 16, transfer charger 17, and fixing roller 18.

Figures 5, 6:
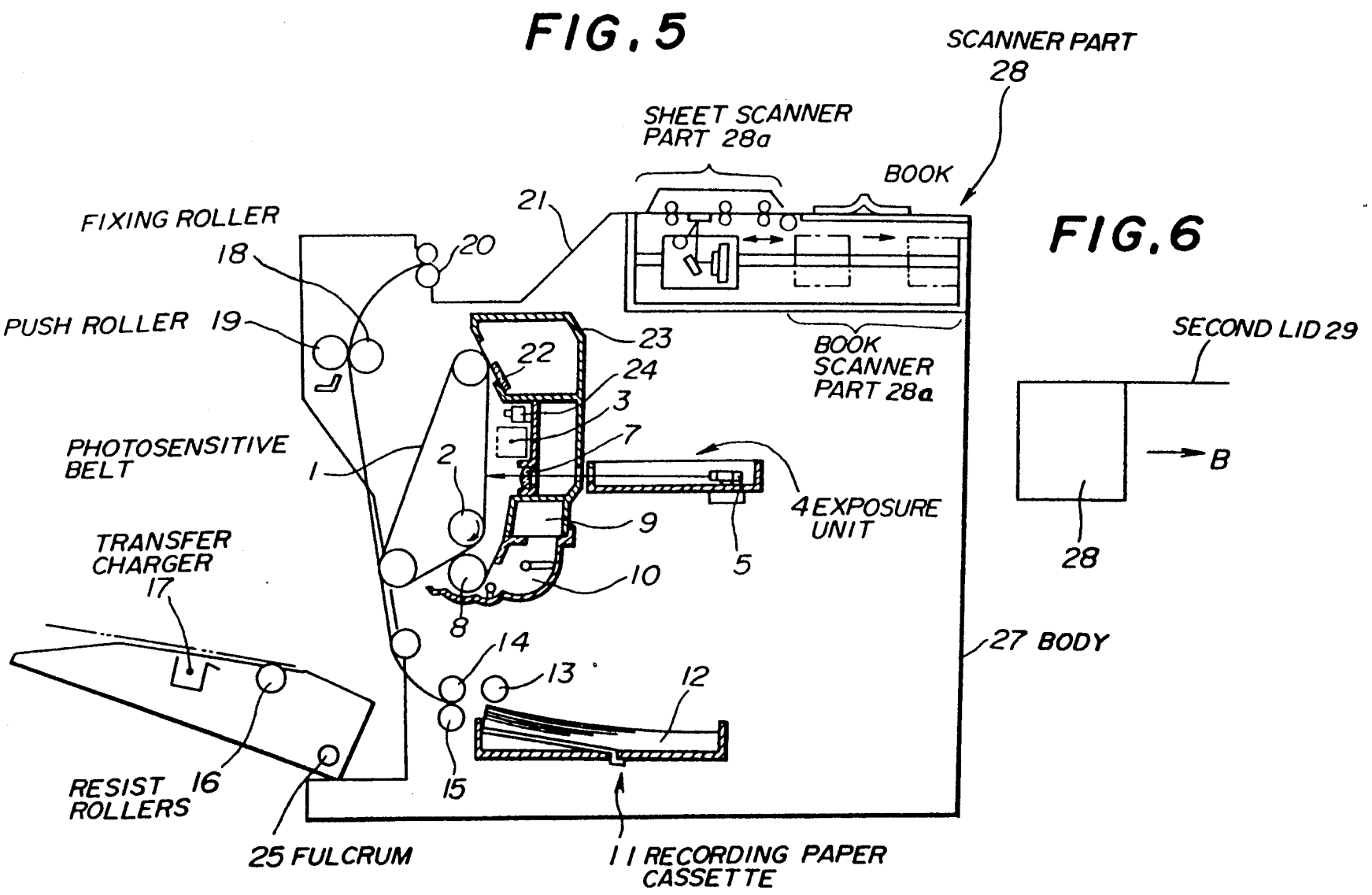
FIG. 5 is a cross-sectional view of the electrophotograph recording apparatus of a second embodiment according to the present invention.
FIG. 6 is a plane view of the overlooked electrophotograph recording apparatus viewed from direction A in FIG. 3.

The toner cartridge 9 and the toner recovery chamber 23 are coupled together with each other so they can be exchanged together. The toner cartridge 9 and the toner recovery chamber 23 are exchanged by means of opening a second lid 29 in a direction B, as shown in FIG. 6. FIG. 6 is a plan view of the electrophotograph recording apparatus viewed from the direction A in FIG. 4. The second lid 29 is opened only when the toner cartridge 9 and the toner recovery chamber 23 are to be exchanged. Thus, the present invention separates the removing means from the exchanging means so that the electrophotograph recording apparatus can be divided approximately along the feed path. Since the toner cartridge 9 and the toner recovery chamber 23 are coupled with each other, they may be exchanged at the same time. Due to this, the present invention serves to simplifying the above operation. Therefore, as the toner cartridge 9 and the toner recovery chamber 23 are coupled via the exposure unit 4 in view of the image forming process, the process does not become complicated.

Another characteristic of the present invention is that the feed path is arranged to extend upwardly. In the conventional electrophotograph recording apparatus, comprising the upper unit and the lower unit, the upper unit would still be heavy even if the removing means were separated from the exchanging means. In view of this, in the present invention, the feed path is arranged to extend upwardly so that the electrophotograph recording apparatus can be divided into a left unit, the first lid 26, and a right unit, the body 27 and the scanning part 28. Incidentally, in this embodiment, the recording paper cassette 11 is located almost at the bottom of the apparatus and the tray 21 is located almost at the top of the apparatus, however, they are both placed upside down.

FIG. 5 shows the electrophotograph recording apparatus of a second embodiment according to the present invention. In this embodiment, the first lid 26 comprises the resist roller 16 and the transfer charger 17. Since the first lid 26 does not include the push roller 19, the first lid 26 becomes so much light.

Still another characteristic of the present invention is that the scanner part 28 is fixed. Since the scanner part 28 is not moved together with the first lid 26, the scanner part 28 can be a relatively heavy. The scanner part 28 comprises a sheet scanner part 28*a* and a book scanner part 28*b*. The sheet scanner scans images on a sheet of feedable paper by means of feeding the paper. On the other hand, the book scanner scans images on an unfeedable manuscript, such as a book or a thick sheet of paper, by means of moving a reading part of the book scanner, such as a light source or CCD, along the manuscript.

Further, the present invention is not limited to these preferred embodiments, as various variations and modifications may be made without departing from the scope of the present invention.

What is claimed is:

1. An image forming apparatus which forms a predetermined image on a recording paper fed through a feed path, comprising:

a body; and a first lid, pivotally provided on said body so as to pivot from a closing position to an opening position, said first lid closing said body when said first lid is located at the closing position, and the feed path being mostly exposed when said first lid is located at the opening position, wherein said body comprising;

a first paper storing member which stores the recording paper, a photosensitive member, said photosensitive member being formed so that a dimension thereof in a direction from the top to the bottom of said body is longer than a dimension thereof in a direction perpendicular to the direction from the top to the bottom of said body, latent image forming means for forming a latent image appropriate to the predetermined image on the photosensitive member, developing means for developing the latent image on the photosensitive member with toner after the latent image forming means forms the latent image on the photosensitive member, a second paper storing member which stores the recording paper on which the predetermined image is formed, the recording paper being fed from the first paper storing member to the second paper storing member, and toner recovery means for recovering remains of toner on the photoconductive member after the transfer means transfers the latent image to the recording paper, the toner recovery means being located in a position adjacent to a top portion of the photosensitive member, and wherein said first lid comprises transfer means for transferring the latent image to the recording paper after the developing means develops the latent image on the photosensitive member with toner.

2. An image forming apparatus according to claim 1, wherein said image forming apparatus further comprises a second lid pivotably provided on said body so as to pivot approximately perpendicular to said first lid, the developing means being exchanged by means of said second lid.

3. An image forming apparatus according to claim 1, wherein said image forming apparatus further comprises scanner means, coupled to said body, for scanning the predetermined image.

4. An image forming apparatus according to claim 3, wherein said scanner means further comprises book scanner means for scanning images on an unfeedable manuscript.

5. An image forming apparatus according to claim 1, wherein said image forming apparatus further comprises feed means, arranged along the feed path and coupled to the first paper storing member and the second paper storing member, for feeding the recording paper from the first paper storing member to the second paper storing member, said feed means further comprising:

a pickup roller, coupled to the first paper storing member, for feeding the recording paper stored in the first paper storing member;

a feed roller for feeding an uppermost recording paper from among the plurality of recording papers fed by the pickup roller;

a separating roller, coupled by the feed roller, for separating a recording paper from a pile of recording papers fed by the pickup roller;

a pair of resist rollers for feeding at a proper time of the recording paper to the transfer means;

a fixing roller for fixing the predetermined image on the recording paper transferred by the transfer means;

a push roller, coupled to the fixing roller, for pushing the fixing roller to fix the predetermined image on the recording paper; and a pair of eject rollers for ejecting the recording paper having the predetermined image thereon to the second paper storing member, wherein one of the resist rollers is provided on said first lid.

6. An image forming apparatus according to claim 5, wherein the push roller is further provided on said first lid.

7. An image forming apparatus according to claim 5, wherein another resist roller is provided on said body and has drive means therein for driving itself and the resist roller provided on said first lid.

8. An image forming apparatus according to claim 6, wherein the fixing roller is provided on said body and has drive means therein for driving itself and the push roller provided on said first lid.

9. An image forming apparatus according to claim 1, wherein the first paper storing member is located almost at a bottom of said body, whereas the second paper storing means is located almost at a top of said body so that the feed path approximately extends from the bottom to the top of said body.

* * * * *